US009079756B2

(12) United States Patent
Beji

(10) Patent No.: US 9,079,756 B2
(45) Date of Patent: Jul. 14, 2015

(54) ELEVATING PLATFORM AND A METHOD OF CONTROLLING SUCH A PLATFORM

(75) Inventor: Slaheddine Beji, Vienne (FR)

(73) Assignee: HAULOTTE GROUP, L'Horme (FR)

( * ) Notice: Subject to any disclaimer, the term of this patent is extended or adjusted under 35 U.S.C. 154(b) by 495 days.

(21) Appl. No.: 12/890,945

(22) Filed: Sep. 27, 2010

(65) Prior Publication Data

US 2011/0088970 A1 Apr. 21, 2011

(30) Foreign Application Priority Data

Sep. 28, 2009 (FR) ..... 09 56679

(51) Int. Cl.

*B66F 11/04* (2006.01)
*B66F 17/00* (2006.01)
*B66C 23/90* (2006.01)

(52) U.S. Cl.

CPC ..... *B66F 11/04* (2013.01); *B66F 11/046* (2013.01); *B66F 17/006* (2013.01); *B66C 23/90* (2013.01)

(58) Field of Classification Search

CPC ..... B66F 11/00; B66F 11/04; B66F 11/042; B66F 11/044; B66F 11/046; B66F 17/00; B66F 17/006; B66C 23/00; B66C 23/88; B66C 23/90; B66C 23/905

USPC ..... 182/2.1, 2.2, 2.3, 2.6, 2.7, 2.8, 2.9, 2.11

See application file for complete search history.

(56) References Cited

U.S. PATENT DOCUMENTS

| | | | | |
|---|---|---|---|---|
| 3,670,849 | A * | 6/1972 | Milner, Jr. | 182/19 |
| 4,178,591 | A | 12/1979 | Geppert | |
| 4,326,601 | A * | 4/1982 | Grove et al. | 182/2.11 |
| 4,331,215 | A * | 5/1982 | Grove et al. | 182/2.1 |
| 4,359,137 | A * | 11/1982 | Merz et al. | 182/2.11 |
| 4,456,093 | A * | 6/1984 | Finley et al. | 182/2.2 |
| 4,514,796 | A * | 4/1985 | Saulters et al. | 700/13 |
| 5,390,104 | A * | 2/1995 | Fulton | 700/65 |
| 6,405,114 | B1 * | 6/2002 | Priestley et al. | 701/50 |
| 6,439,341 | B1 * | 8/2002 | Engvall et al. | 182/18 |
| 7,004,285 | B2 * | 2/2006 | Bailey | 182/19 |
| 2003/0000757 | A1 * | 1/2003 | Ishida et al. | 180/271 |
| 2003/0174064 | A1 * | 9/2003 | Igarashi et al. | 340/685 |
| 2011/0042164 | A1 * | 2/2011 | Clark et al. | 182/2.2 |

FOREIGN PATENT DOCUMENTS

| | | | |
|---|---|---|---|
| EP | 1746064 | A2 | 1/2007 |
| EP | 1829812 | A2 | 9/2007 |
| EP | 1923347 | A1 | 5/2008 |
| JP | 03238300 | A | 10/1991 |
| WO | 2005092778 | A1 | 10/2005 |

* cited by examiner

*Primary Examiner* — Colleen M Chavchavadze
(74) *Attorney, Agent, or Firm* — Dowell & Dowell, PC

(57) ABSTRACT

An elevating platform including a chassis having a motor drive unit, a platform, elevator for elevating the platform relative to the chassis, sensors for delivering signals representative of a configuration of the elevating platform or its environment, a control unit for controlling the elevator means as a function of a plurality of parameters, including parameters corresponding to the signals delivered by the sensors, and a selector for selecting at least one priority parameter and a threshold value for the parameter whereby the control unit determines operating conditions for the elevating platform under which the threshold value for the priority parameter can be reached, and for controlling at least the elevator within a limit of the operating conditions.

8 Claims, 3 Drawing Sheets

ELEVATING PLATFORM AND A METHOD OF CONTROLLING SUCH A PLATFORM

BACKGROUND OF THE INVENTION

1. Field of the Invention

The invention relates to an elevating platform, and to a method of controlling such a platform.

2. Brief Description of the Related Art

It is known that the operation of an elevating platform can be made more reliable by determining limit values for certain operating parameters for such an elevating platform. It is known from FR-A-2 908 119 that it is possible to define a volume defined by a "safety nomogram" within which the top end of the boom of an elevating platform must be maintained, in order to prevent the elevating platform from tipping. As mentioned in EP-A-1 378 483, the stability envelope for an elevating platform is defined on the basis of the physical characteristics of said elevating platform, such as the length of the boom or the weight of certain portions of the machine. When the machine has an inclinable boom, the safety envelope relates mainly to the relationship between the maximum height that can be reached by the end of the boom and the offset of said end of the boom relative to a central axis of the chassis of the elevating platform. The operating conditions of an elevating platform also include limit values resulting from its environment, in particular from the speed of the wind to which it can be subjected, the slope or cant of the ground on which it is resting, or the weight of the load that it can bear.

The elevator means for elevating the platform are generally controlled by an electronic unit that takes account of those various parameters and limits the movements of the elevating platform when said elevating platform might operate outside its safety envelope or under conditions close to the limit values defined by the envelope. In this context, each of the parameters taken into account by a control unit can vary within a range defined by threshold values. Each of the threshold values is defined by taking account of the maximum threshold values for the other parameters. For example, the maximum allowable cant value for the ground on which the elevating platform stands is determined by taking account of the maximum height and of the maximum offset of the platform relative to the ground, and/or of the maximum weight of a load disposed on said platform and/or of the maximum speed of the wind to which the elevating platform can be subjected.

However, it is sometimes necessary for an elevating platform to operate under conditions that lie outside the normal operating range, which is not possible with current elevating platforms, without endangering the user and anyone in the vicinity of the elevating platform.

SUMMARY OF THE INVENTION

A particular object of the invention is to remedy those drawbacks by proposing a novel elevating platform that operates more reliably than prior art elevating platforms.

To this end, the invention provides an elevating platform comprising a chassis equipped with a motor drive unit and with ground-engaging means, a platform, elevator means for elevating the platform relative to the chassis, sensors, each delivering a signal representative of the configuration of the elevating platform or of its environment, and a control unit for controlling the elevator means as a function of a plurality of parameters, including parameters corresponding to the signals delivered by the sensors. Said elevating platform further comprises selector means for selecting at least one priority parameter and a threshold value for said parameter, and in that the control unit is suitable for determining operating conditions for the elevating platform under which the threshold value for the priority parameter can be reached, and for controlling at least the elevator means within the limit of these operating conditions.

By means of the invention, it is possible to identify one or more parameters as being priority parameters, it being possible for the priority parameter(s) to be taken into account in preferential manner for setting the operating conditions for the elevating platform. In particular, selecting a priority parameter makes it possible to use the elevating platform under conditions under which said parameter has a high value, even if, to do so, the limit values of one or more other parameters are reduced.

In advantageous but non-essential aspects of the invention, such an elevating platform may incorporate one or more of the following characteristics, taken in any technically feasible combination:

- The selector means comprise a display suitable for showing various parameters that are suitable for being selected as priority parameter and at least one input member for inputting a command for selecting one of the displayed parameters as priority parameter, and for inputting a threshold value for said priority parameter.
- A display device is provided for displaying, in graphical form and/or alphanumeric form, limit operating conditions for the elevating platform that are determined by the control unit.

The invention also provides a method of controlling an elevating work platform as mentioned above, which method makes it possible to adapt operation of the elevating platform to suit its planned operating conditions. This method comprises steps consisting in:

a) determining at least one priority parameter from among the parameters used by the control unit;

b) choosing a threshold value for said priority parameter;

c) determining, as a function of the threshold value chosen in step b), operating conditions for the elevating platform, under which conditions the threshold value for the priority parameter can be reached; and d) controlling at least the elevator means within the limit of these operating conditions determined in step c).

In advantageous but non-essential aspects of the invention, such a method may incorporate one or more of the following characteristics, taken in any technically feasible combination:

- During step c), at least one limit value is determined for at least one other parameter used by the control unit, as a function of the threshold value chosen for the priority parameter. In which case, step c) is performed at least in part by calculating the limit value of the other parameter. Alternatively or in addition, step c) may be performed at least in part by accessing a memory containing data relating to a plurality of predetermined operating configurations for the elevating platform.
- An additional step d) is provided in which the operating conditions determined during step c) are displayed.
- Another step e) is provided subsequent to step b) and prior to step c) and in which it is checked that the value determined in step b) is consistent with the configuration of the machine that is determined by the sensors, while step c) is implemented as a function of the result of the consistency check of this other step.
- The priority parameter is representative of the choice made by a user as to whether or not to govern operation of the elevating platform.

BRIEF DESCRIPTION OF THE DRAWINGS

The invention can be better understood and other advantages of the invention appear more clearly from the following description of an embodiment of an elevating platform of the invention and of a method of controlling said elevating platform, the description being given by way of example and with reference to the accompanying drawings, in which.

DESCRIPTION OF THE PREFERRED EMBODIMENT

Figure 1:
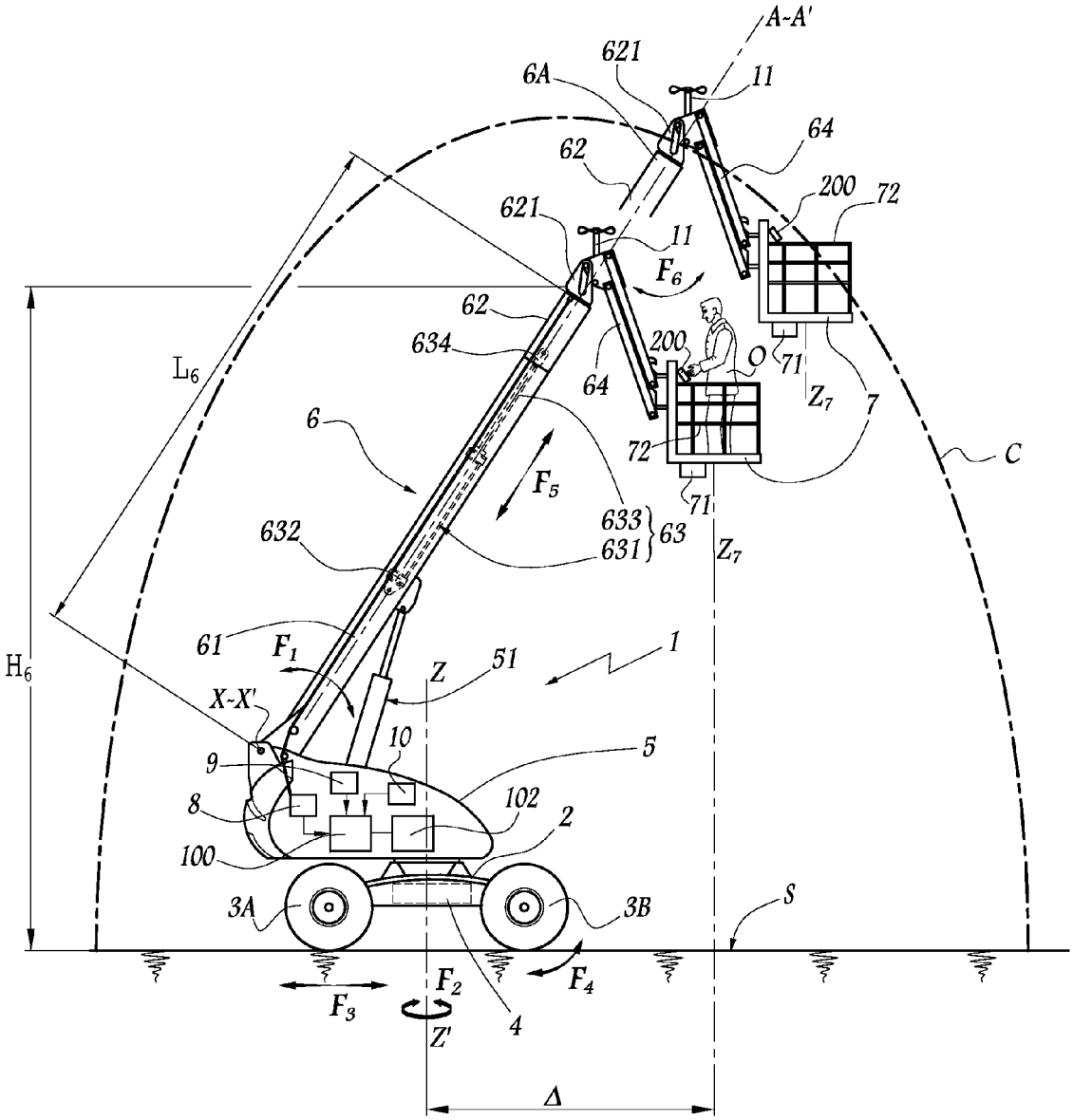
FIG. 1 is a diagrammatic side view of a boom lit of the invention.

The elevating platform 1 shown in FIG. 1 includes a chassis 2 that stands on the surface S of the ground via four wheels, two of which are visible, referenced 3A and 3B, the four wheels forming means for engaging the ground. In place of the wheels, the chassis 2 could be equipped with crawler tracks or with other members for engaging the ground. The wheel 3A is a driven wheel, i.e. it is a wheel connected to an electric motor 4 incorporated into the chassis 2. The wheel 3B is steerable, i.e. its angular position relative to the chassis 2 can be varied, thereby making it possible to steer the elevating platform 1.

A base 5 is pivotally mounted on the chassis 2 to pivot about an axis Z-Z' that is perpendicular to the surface S of the ground. A telescopic boom 6 is hinged to the base 5 about an axis X-X' that is perpendicular to the axis Z-Z'. Double-headed arrow $F_1$ in FIG. 1 represents the pivoting movement of the boom 6 about the axis X-X', this movement being controlled by means of an actuator 51 disposed between the components 5 and 6.

Double-headed arrow $F_2$ shows the pivoting movement of the base 5 relative to the chassis 2, about the axis Z-Z'. Double-headed arrow $F_3$ represents the forward and reverse movement of the elevating platform relative to the surface S, whereas double-headed arrow $F_4$ represents the possible changes in direction of the elevating platform 1.

The boom 6 is telescopic in that it comprises a tube 61 that is hinged to the base 5 and a portion 62 that is adapted to slide inside the tube 61, while being controlled by a hydraulic actuator 63 having a body 631 secured to the tube 61 by means of a fastening lug 632. The rod 633 of the actuator 63 is equipped with a fastening lug 634 for fastening to the portion 62.

As a function of the activation of the actuator 63, the portion 62 moves parallel to a longitudinal axis A-A' of the boom 6, relative to the tube 61, as represented by doubled-headed arrow $F_5$. Two positions of the portion 62 relative to the tube 61 are shown in FIG. 1, and they illustrate this possibility of extension of the boom 6.

The top end 6A of the boom, i.e. the portion 62 that is furthest away from the tube 61 is provided with a yoke joint 621 for fastening to a parallelogram structure 64 from which a platform 7 is suspended, on which platform an operator O can stand, or on which platform loads to be elevated can be placed.

The structure 64 is equipped with an actuator (not shown) such as a jack, making it possible to move the platform 7 while keeping it parallel to itself, as represented by double-headed arrow $F_6$.

In order to avoid the risks of the elevating platform 1 tipping over, it is known that the top end 6A of the boom 6 must remain inside a volume having a limit represented by the curve C in FIG. 1, said curve sometimes being referred to as a "safety nomogram" or as a "work nomogram" for the elevating platform.

Reference $L_6$ designates the length of the boom 6 measured from the axis X-X' to the junction zone where the portion 62 meets the yoke joint 621. This length $L_6$ is variable as a function of the action of the actuator 63. Reference $Z_7$ designates an axis parallel to the axis Z-Z' and passing through the center of the platform 7. Reference Δ designates the lateral offset of the platform 7 relative to the chassis 2, this offset being defined as being the radial distance between the axes Z-Z' and $Z_7$. This lateral offset is variable as a function of the three-dimensional position of the platform 7.

Reference $H_6$ is the height of the top end 6A of the boom 6 relative to the ground. The height $H_6$ varies as a function of the length $L_6$ of the angle of inclination of the boom relative to the axis Z-Z'.

A sensor 8 makes it possible to determine the length $L_6$ by direct measurement, whereas a second sensor 9 makes it possible to measure the angle of inclination of the boom 6.

Other sensors (not shown) make it possible to determine the position of the parallelogram structure 64 relative to the boom 6.

Another sensor 10 incorporated in the base 5 makes it possible to determine the angle of any cant of the surface S on which the elevating platform 1 is situated. An anemometer 11 is mounted in the vicinity of the yoke joint 621 and makes it possible to determine the speed of the wind in the vicinity of the top portion of the boom 6 and of the platform 7.

A weight measurement device 71 fastened to the platform 7 makes it possible to determine the weight of the load carried on the platform 7, whether it be the weight of the operator O and/or the weight of the objects that the operator wishes to elevate relative to the surface of the ground S. The device 71 is part of a system for monitoring the carried load, the other components of the system not being shown so as to make the drawing clearer.

The output signals from the various sensors and from the device are delivered to an electronic control unit 100 that, in particular, controls the motor 4, the actuators 51 and 63, and the actuator (not shown) for actuating the parallelogram structure 64.

A control console 200 is mounted on a guardrail 72 of the platform 7.

This console enables the operator O to control the wheels 3B, the motor 4, the actuators 51 and 63, and the means for moving the structure 64. For this purpose, the console is equipped with one or more control members, e.g. of the joystick type, and with a display that are incorporated into the portion of the console 20 that is not visible in FIGS. 2 and 3.

The console 200 also enables the operator O to give preference to a parameter relating to the elevating platform 1 for the purpose of determining the safe operating conditions therefor.

Figure 2:
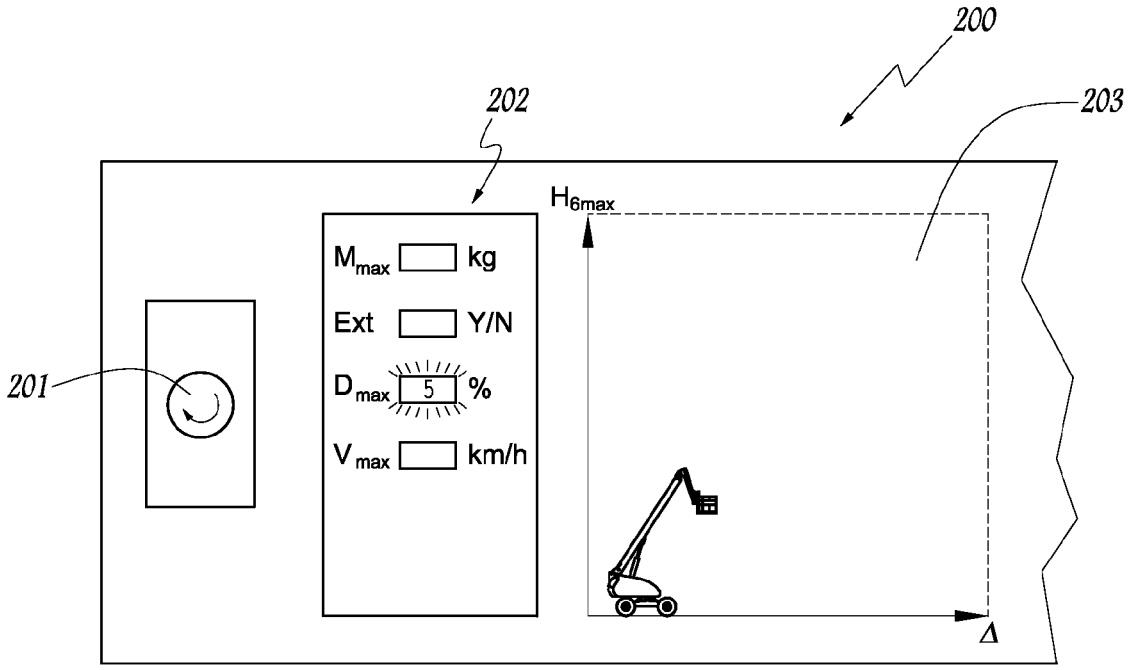
FIG. 2 is a fragmentary front view of a control console that belongs to the elevating platform of FIG. 1, when the control means for controlling the elevating platform are in a first configuration.

The portion of the console 200 that is shown in FIG. 2 includes a rotary knob 201 that can be pushed in to select a value. This console portion 200 also includes a primary display 202 designed to display the maximum weight $M_{max}$ that can be supported by the platform 7 when the elevating platform 1 is operating normally. The display 202 displays a value "yes" (Y) or a value "no" (N) corresponding to whether the elevating platform can be used in an exterior environment, i.e. outdoors, in particular an environment subjected to wind speed. The display 202 also makes it possible to display the maximum can value $D_{max}$, expressed in percents and concerning the surface S of the ground on which stands the elevating platform 1. Finally, the display 202 may display the maximum wind speed $V_{max}$, expressed in kilometers per hour (km/h), to which the elevating platform 1 can be subjected under normal outdoor operating conditions.

The console 200 also includes a graphical display 203 showing a graphical representation of the elevating platform 1 and, along the x-axis, the offset Δ of the platform 2 relative to the base 5, and, up the y-axis, the height $H_6$ of the boom 6.

When it is desired to use the elevating platform 1, a first step 501 of a method of controlling the elevating platform is implemented. In this first step, the current configuration of the machine and of its environment is determined. This step 501 breaks down into an elementary step 5011 for determining the position of the articulated structure made up of the boom 6 and of the parallelogram structure. This determination takes place by means of the sensors 8 and 9, and by means of the sensor associated with the structure 64. It makes it possible, in particular, to determine the height $H_6$ and the offset Δ. The step 501 also includes an elementary step 5012 in which the cant D of the surface S, i.e. its inclination relative to the horizontal is determined. This determination takes place by means of the sensor 10. During an elementary step 5013 of the step 501, the value of the weight M carried by the platform is determined, by means of the cell 71. During another elementary step 5014 of the step 501, the speed of the wind to which the articulated structure of the elevating platform 1 is subjected is determined, by means of the anemometer 11.

The method of the invention also includes a step 502 during which the operator O selects, from among the parameters displayable on the display 202, that parameter that the operator considers as being a priority for operation of the elevating platform. Said parameter may be the maximum weight that can be carried on the platform 7, i.e. $M_{max}$. Said parameter may be whether the elevating platform 1 can work indoors or outdoors, i.e. Ext/Int. Said parameter may be the maximum value $D_{max}$ of the cant of a surface on which the elevating platform 1 can operate. Said parameter may also be the maximum speed $V_{max}$ of the wind to which the elevating platform 1 can be subjected.

The parameter considered by the user as being a priority or as to be given preference is selected by turning the knob 201 until a window disposed facing the name of the parameter is highlighted by brightening. In the example shown in FIG. 2, the user has highlighted the window corresponding to maximum allowable cant.

After highlighting the window corresponding to the parameter to be given preference, $D_{max}$ in the example, the user actually selects the parameter by pressing on the knob 201 while the corresponding window is highlighted. This corresponds to the step 502 of selecting the preferred parameter.

During a step 503 following step 502, the user chooses a threshold value for the parameter that said user has identified as to be given preference. This threshold valve can be an upper or a lower limit value. In practice, the threshold value of the preferred parameter is selected by turning the knob 1 until the desired value is displayed in the highlighted window.

In the example shown in FIG. 2, the user has selected a value of 5% as being the upper value for the cant D of the surface of the ground S on which the elevating platform can operate.

During a subsequent step 504, the unit 100 checks that the selected threshold value for the preferred parameter, in the example the value of 5% for the maximum allowable cant $D_{max}$, is consistent with the configuration of the machine and of its environment as determined in step 501. If this consistency check is negative, the unit 100 goes to a step 505 for making the machine safe, and the user is invited to implement steps 502 and 503 again, by selecting either another parameter as the parameter to be given preference, or another threshold value for the previously selected parameter.

If step 504 determines that the threshold value selected for the preferred parameter is consistent with the configuration of the machine that is determined in step 501, the unit 100 goes to a step 506 during which it determines the allowable threshold values for the other operating parameters of the machine. This step 506 may be performed by means of calculations performed by the unit 100. It may also be performed by accessing a memory 102 containing data relating to various possible configurations for the elevating platform 1, the unit 100 then selecting from among this data a set of data corresponding to a configuration in which the selected value for the preferred parameter, in the example 5% for the maximum cant $D_{max}$, can be reached.

In a variant, the step 506 may be performed both by accessing the memory 102 and by performing calculations.

Figure 3:
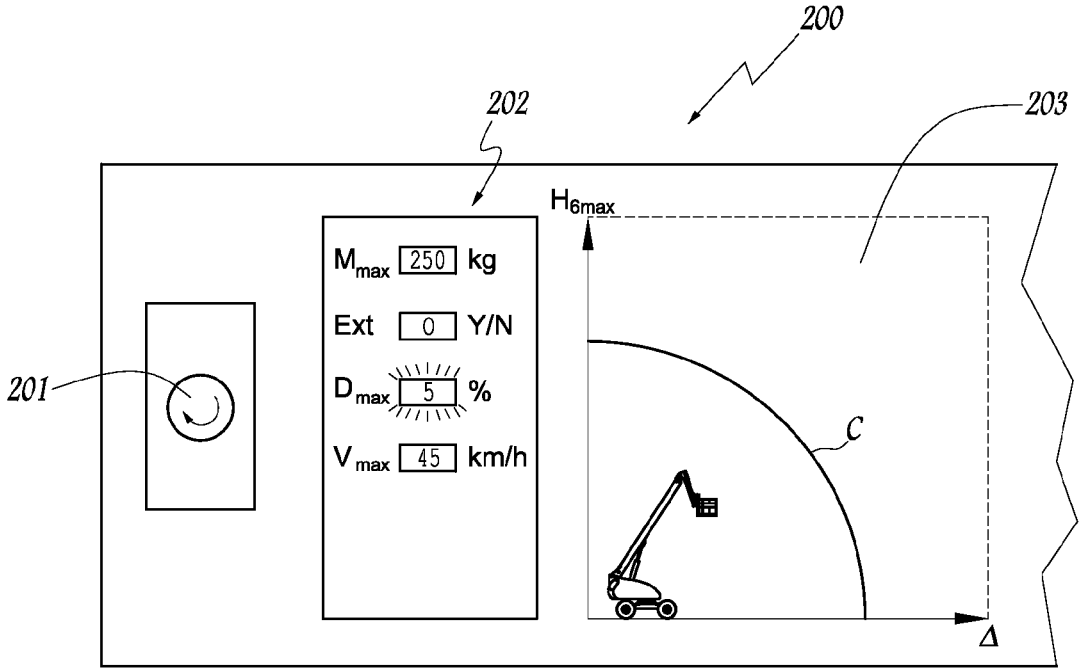
FIG. 3 is a view analogous to FIG. 2 when the control means are in a second configuration.
Figure 4:
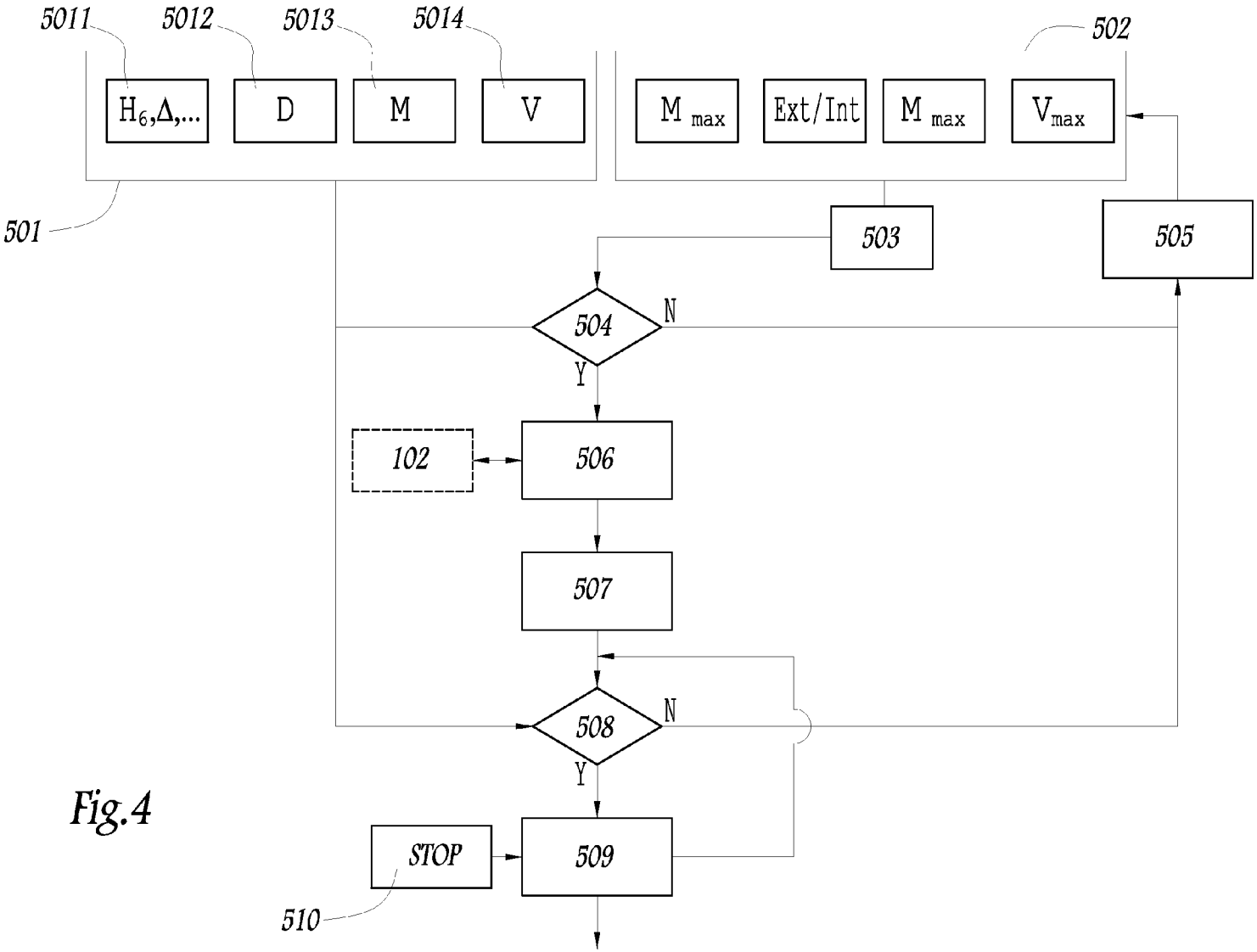
FIG. 4 is a flow chart of a method of controlling the elevating platform of FIG. 1 by means of the console of FIGS. 2 and 3.

At the end of step 506, the limit configuration determined by the unit 100 is displayed on the console 200, as shown in FIG. 3. More precisely, threshold values determined for the parameters other than the parameter that is given preference are displayed firstly on the primary display 202, and secondly in graphical form on the display 203. The threshold values displayed on the primary display 202 concern the maximum weight that can be disposed on the platform 7, i.e. $M_{max}$, whether or not the elevating platform can be used outdoors ("Ext" value "Y" or "N"), and maximum allowable speed for the wind to which the elevating platform is subjected, i.e. $V_{max}$.

In addition, the step 506 also makes it possible to determine the safety nomogram or the work nomogram C to be used, which nomogram is represented in graphical form on the display 203, with a maximum height for the boom 6 $H_{6max}$ represented as a function of the offset Δ of the platform 7.

The operator O situated on the platform 7 can thus be informed of the influence that the choice made by the operator for the maximum value $D_{max}$ of the cant has on the other operating parameters of the elevating platform 1, in terms of maximum carried weight, in terms of operating outdoors, in terms of maximum allowable wind speed, and in terms of maximum allowable height as a function of the offset.

Then, in a subsequent step 508, the limit values determined in step 506 are compared with the values determined during the step 501 that is repeated at regular intervals during use of the elevating platform 1, e.g. every 40 milliseconds (ms). If the result of this consistency check is positive, i.e. if the values determined in step 501 do not exceed the values determined in step 506, then the operating conditions determined by the unit 100 are used by said unit in step 509 to control the actuators 51 and 63, and the means for actuating the parallelogram structure 64 as a function of the movement instructions input by the operator O. These operating conditions may also be used to control the motor 4 and the steerable wheels 3B.

If the consistency check in step 508 shows that the values determined in step 501 might exceed one or more of the threshold values determined in step 506, the unit goes to step 505 for making the elevating platform 1 safe.

Thus, by means of the invention, the user can choose a parameter, such as maximum allowable cant $D_{max}$ in the example mentioned above, as being a priority parameter for determining the operating conditions of the elevating platform 1, i.e., in practice, the limit or threshold values of the other parameters that are determined as a function of a threshold value set for this priority parameter. The invention thus makes it possible to cause the elevating platform to operate under conditions that are not necessarily accessible for a conventional elevating platform, insofar as the value selected for the priority parameter can lie outside the conventional operating ranges for known elevating platforms.

Once the value of the preferred parameter has been chosen, that value can be used to limit the threshold values of the other parameters, relative to a conventional configuration.

For example, the value of 5% chosen for the maximum allowable cant can result in the maximum carried load being reduced to 250 kilograms (kg) whereas the elevating platform can normally carry a load of 400 kg under normal operating conditions, under which the possible cant is less than 3%.

In a variant, at this stage, a choice may be left up to the operator for indicating which parameter, other than the preferred parameter, can have its value reduced or modified preferably so that the selected value for the preferred parameter can be reached. In the above example, the operator can choose that, during the step 506, the value for the maximum carried load $M_{max}$ be reduced preferably to the value for maximum offset Δ. In another approach, the operator may prefer the maximum height $H_{6max}$ to be reduced rather than modifying the other parameters. In another variant, the operator may choose a plurality of parameters, e.g. $M_{max}$ and $H_{6max}$, the values of which are adjusted preferably as a function of the selected value for the preferred parameter.

The invention is described above in the situation in which the operator has the choice between four parameters as potential priority parameters. Naturally, the number of these potential priority parameters and their types can be adapted as a function of the choices of the designer of the elevating platform. Other parameters that can be used as priority parameter are the number of persons that can be on the platform 7, the maximum offset Δ, or the height $H_6$.

Another potential priority parameter concerns whether a referenced user, who can be termed an "administrator", might wish to govern the performance of an elevating platform in order to broaden its range. In other words, a priority parameter can concern whether or not an administrator gives access to all of the operating ranges of an elevating platform. The use of such a parameter as the priority parameter enables the administrator, who may be the representative of an elevating platform rental business, to limit the performance of an elevating platform when it is hired out for a precise purpose, in place of an elevating platform having lower theoretical performance. This enables a rental business to broaden its range using the same elevating platform.

The invention is described above in the situation when the elevating platform 1 is equipped with an anemometer 11. By way of a variant, said anemometer can be replaced with a portion of the console 200 in which the operator O directly indicates the maximum value of the speed of the wind to which the elevating platform 1 can be subjected, within the normative limits. In this case, during the step 5014, the maximum value indicated by the operator is taken into account. For normative reasons, in Europe, the value indicated by the operator cannot be less than 45 km/h, if the elevating platform is designed to be used outdoors.

The means for selecting the preferred parameter(s) may be different from the console 200 shown in the figures. For example, they may comprise cursors that are mounted to move in translation, "+" and "−" keys making it possible to increase or to decrease a value etc.

The invention is described above in the situation in which a single priority parameter is to be given preference. However, in a variant, it is possible to give preference to more than one priority parameter, the allowable values of the other parameters being determined as a function of the values of these priority parameters.

The invention has been shown in the situation in which the elevating platform is an elevating platform having an inclinable telescopic boom. It is applicable to any type of elevating platform, in particular scissor lifts and elevating platforms having vertical booms or masts, regardless of whether such elevating platforms are self-propelled or towed.

The invention is described above in the situation in which the selected threshold value is a maximum value, in particular when it is maximum allowable cant. It may also be a minimum value, e.g. for weight $M_{max}$, or a binary value for whether or not the elevating platform can be used outdoors.

The invention can be implemented with any unit system to measure the parameter, e.g. pounds instead of kilograms as MPH instead of Km/h.

The invention claimed is:

1. A method of controlling an elevating work platform mounted to a machine having a chassis equipped with a motor drive unit and with ground-engaging drive elements, an elevating work platform, an elevator for elevating the elevating work platform relative to the chassis, a plurality of sensors operable for delivering signals representative of a configuration of the elevating work platform and surrounding environmental conditions to an electronic controller for controlling the elevator as a function of a plurality of parameters including parameters corresponding to the signals delivered by the sensors, the controller communicating with a console mounted to the elevating work platform, the console including a selector for selecting at least one priority parameter from a plurality of the parameters and a threshold value for the selected at least one priority parameter, wherein the method comprises steps of:

a) Using the sensors to sense at least a current configuration of the machine including the elevating work platform and elevator and communicating the sensed current configuration to the controller;

b) Viewing a display showing various parameters that are suitable for being selected as a priority parameter and using the selector to select at least one priority parameter, which the user identifies as being the priority parameter, from among the plurality of parameters on the console;

c) Using the selector to select a threshold value, that the user identifies as a limit for the at least one selected priority parameter;

d) Using the controller to determine, as a function of step a) and the threshold value chosen in step c), operating conditions for the elevating work platform, under which conditions the threshold value for the priority parameter can be safely reached; and e) controlling movement of at least the elevator within a limit of the operating conditions determined in step d).

2. The method according to claim 1, wherein, during step d), at least one threshold value is determined for at least one other parameter used by the controller, as a function of the threshold value chosen for the priority parameter.

3. The method according to claim 2, wherein during step d) the controller calculates the threshold value of the at least one other parameter.

4. The method according to claim 1, wherein step d) is performed at least in part by the controller accessing a memory containing data relating to a plurality of predetermined operating configurations for the elevating work platform.

5. The method according to claim 1, including an additional step of displaying the operating conditions determined during step d) on the console.

6. The method according to claim 1, including a step subsequent to step c) and prior to step d) wherein the controller determines whether the threshold value selected in step c) is consistent with a configuration of the elevating work platform that is determined by the sensors in step a), and in that step d) is implemented as a function of the result of the consistency check of step e).

7. A method according to claim 1, wherein if during step d) the controller determines that the threshold value of the priority parameter cannot be safely reached, a signal is displayed on the console to select a different priority parameter and thereafter using the selector to select a different priority parameter and thereafter using the selector to select a threshold value for the different priority parameter.

8. The method according to claim 1 wherein the parameters include environmental wind speeds, terrain slope, boom extension and angle of inclination and height, weight carried by the platform, weight of portions of the machine, offset of the platform relative to the boom, position of platform relative to a chassis of the machine, and indoor and outdoor operation of the machine.

* * * * *